United States Patent [19]

Robertson

[11] Patent Number: 4,870,922

[45] Date of Patent: Oct. 3, 1989

[54] APPARATUS FOR MARKING FRAGILE SURFACES

[75] Inventor: John A. Robertson, Chillicothe, Ohio

[73] Assignee: Telesis Controls Corporation, Chillicothe, Ohio

[21] Appl. No.: 192,860

[22] Filed: May 11, 1988

[51] Int. Cl.[4] ..... B05C 11/10; B05B 7/06; B05B 12/02

[52] U.S. Cl. ..... 118/702; 118/300; 118/703

[58] Field of Search ..... 118/702, 703, 699, 300; 427/256; 239/67, 70, 365, 415; 377/111

[56] References Cited

U.S. PATENT DOCUMENTS 3,294,058 12/1966 Shriro ..... 118/702 X
3,391,305 7/1968 Bradwin et al. ..... 377/107 X
4,408,562 10/1983 DeCamp et al. ..... 118/702 X
4,661,719 4/1987 Burchfiel et al. ..... 239/70 X

*Primary Examiner*—Evan Lawrence
*Attorney, Agent, or Firm*—Mueller and Smith

[57] ABSTRACT

A marker is described which is utilized for marking surfaces which are fragile such as those of glass products just following molding procedures. A compact housing having a self-contained reservoir of marking fluid, a solenoid actuated nebulizing nozzle, and an air valve are employed with a self-contained circuit to nebulize a small quantity of marking fluid in a manner wherein the interval of expression of fluid from the nozzle is bracketed by a minimum interval of nebulizing air flow. As a result, only a short puff of nebulizing activity occurs which provides effective marking of the hot surface while avoiding any damage thereto.

12 Claims, 2 Drawing Sheets

TO INK SOLENOID 30
TO AIR SOLENOID 44
24VAC INPUT
+12V
IN
OUT
GND
CP
CE
R
COUT
Q6
Q7
Q8
Q9
110
112
114
116
118
120
122
124
126
128
130
132
134
136
137
138
140
142
146
148
150
152
154
156
158
162
164
166
168
170
172
174
176
178
180
182
184
186
188
190
192
196
198
200
32
34
48
R1
R2
R3
R4
R5
R6
R7
R8
R9
C1
C2
C3
C4
C5
D1
D2
D3
D4
D5
D6
D7
D8
D9
D10
D11

APPARATUS FOR MARKING FRAGILE SURFACES

BACKGROUND OF THE INVENTION

A broad variety of techniques have been developed by industry for placing identifying marks on products in the course of their production and subsequent distribution. The environment of the marking activity and physical nature of the object being marked has lead to a broad range of marking techniques, extending from the stamping of identifying marks and messages on hot steel ingots to ink-jet systems for making dot-matrix formed character strings on packing boxes. Because of a continuing emphasis on tracking products essentially from their origin in the production process to their point of shipment, conventional marking techniques have been found to be limited. For example, it has been found desirable to mark important glass products such as glass envelopes for cathode ray-type structures and the like very early in the process of their manufacture, i.e. just shortly following their geometric formation. With such early marking, the glass batch forming the product can be identified as well as the initial machine producing that product. To meet such requirements, marking identification must be placed on a glass surface which may exhibit temperatures somewhat close to the molten state, i.e. at temperatures of about 1800° F. Conventional ink-jet marking techniques are not suited to marking such hot glass surfaces, inasmuch as the usually encountered liquids and air flows associated with such system will cause localized thermal stress with resulting crazing problems. As a consequence, the approach taken heretofore by industry has been a manual one, in which the hot fragile products are marked by hand with a soap stone or the like. The latter approaches do not lend themselves to modern industrial production techniques.

SUMMARY OF THE INVENTION

The present invention is addressed to apparatus and method for marking surfaces which are fragile to thermal variation, for example the surfaces of glass products just following their formation wherein their geometric shapes are established but the glass from which they are formed remains close to melt temperature. This marking technique employs a compact marking devise utilizing marker fluid from within a self-contained reservoir in conjunction with air under pressure to nebulize a small quantity of the fluid at a location in spaced adjacency from the surface to be marked. Minimized cooling of the surface by the nebulizing air combined with assured full nebulization of the fluid expressed from the device is achieved by bracketing the interval of fluid expression with a short interval of entraining air release. Thus, adverse thermal effects at the marked surface are avoided. By combining the control circuitry in a protective module with each marker device, economies of production and use within the hostile environment necessarily encountered are achieved.

A particular aspect of the invention resides in the provision of apparatus for marking surfaces at elevated temperature fragile to thermal variation with a quantity of marking fluid nebulized from a source of air under pressure forming an identification mark which includes a housing mountable in the vicinity of the surface as well as an arrangement for supplying a quantity of the marking fluid sufficient only to form the mark while avoiding damage to the surface induced by localized cooling effects. A nozzle is mounted on the housing having a fluid outlet communicating with the supply of marking fluid and which is actuable for releasing a quantity of the fluid. The nozzle includes an air inlet and an air outlet which is adjacent the fluid outlet for receiving air under pressure and the inlet and effecting a nebulization of the released fluid. An air valve connectable with a source of air under pressure and with the nozzle air inlet is actuable to supply air under pressure to the nozzle air inlet and a control is provided for selectively actuating the nozzle and the air valve in pulsed fashion wherein the air valve effects commencement of an entraining air flow from the nozzle air outlet subsequent to which the nozzle expresses the quantity of marking fluid within a first predetermined interval and the air valve effects termination of the air flow subsequent to the first predetermined interval to define a second predetermined interval of air flow having a minimal duration selected to effect nebulization of the expressed quantity of marking fluid and avoid damage to the surface due to thermal effects.

Still another particular feature of the invention resides in the provision of apparatus for marking fragile surfaces at elevated temperature to form a discrete identification mark with marking fluid in conjunction with a source of gas under pressure in response to an a.c. input signal. The apparatus includes a housing mountable in the vicinity of the surface as well as an arrangement for supplying a quantity of the marking fluid. A nozzle is mounted on the housing having a fluid outlet communicating with the supply of fluid and an electromagnetic fluid actuator energizable for releasing the fluid for expression through the fluid outlet and having a gas outlet adjacent the fluid outlet communicating with a gas inlet for effecting a transport of the express fluid toward the surface. An air valve is connectable with the source of gas and with the nozzle gas inlet and is actuable to effect release of the gas under pressure through the gas outlet in response to energization of an electromagnetic valve actuator. A control is provided which includes a first drive responsive to a first on signal for energizing the electromagnetic valve actuator, a second drive arrangement is responsive to a second signal for energizing the electromagnetic fluid actuator, a counter is responsive to the a.c. input to sequentially activate a sequence of output terminals. A first connector provides for coupling a predetermined sequence of at least three of the terminals from first to last with the first drive means to apply the first on signal thereto to effect the actuation of the air valve for a first interval having a minimal duration selected to effect said transport and nebulization of the fluid while avoiding damage to the surface due to localized cooling, and a second connector for coupling at least one of the terminals intermediate the first to last terminals with the second drive to apply the second on signal thereto for a second interval occuring intermediate the first interval and selected of duration sufficient only to express an amount of fluid to form the mark while avoiding damage to the surface induced by localized cooling effects.

Other objects and features of the invention will, in part, be obvious and will, in part, appear hereinafter.

The invention, accordingly, comprises the apparatus and method possessing the construction, combination of elements, arrangement of parts and steps which are exemplified in the following detailed disclosure.

For a fuller understanding of the nature and objects of the invention, reference should be had to the following detailed description taken in conjunction with the accompanying drawings.

DETAILED DESCRIPTION OF THE INVENTION

Figure 1:
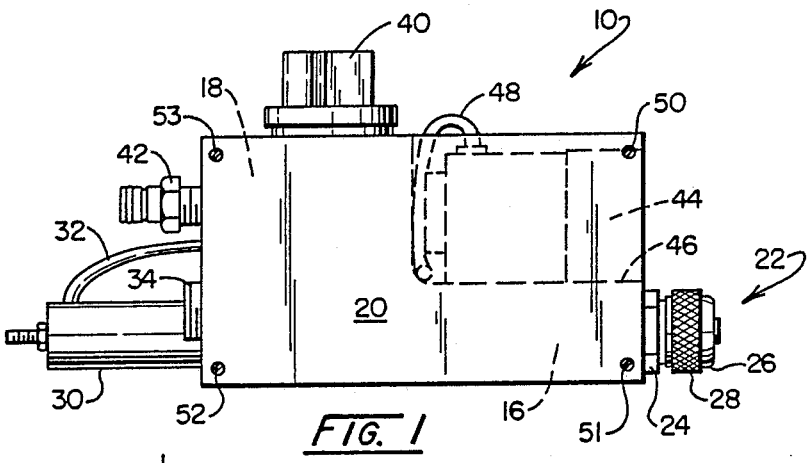
FIG. 1 is a side elevational view of a marker apparatus according to the invention.
Figure 2:
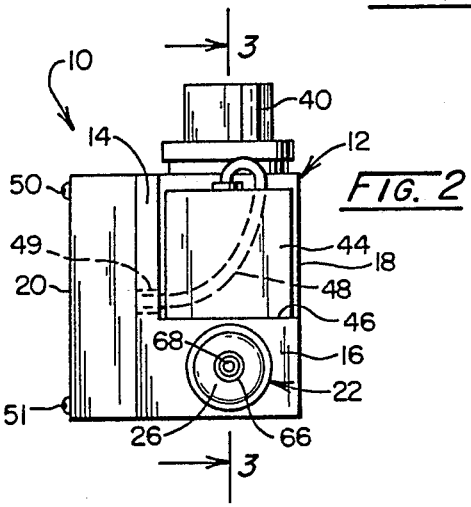
FIG. 2 is a front view of the marker apparatus of FIG. 1.

Referring to FIGS. 1 and 2, a stand-alone marker apparatus according to the invention is revealed generally at 10. Apparatus 10 is relatively small and compact and is suited for mounting in somewhat close proximity to the surface to be marked, for example a surface of a glass product such as an envelope for a cathode ray-type tube which is in a production phase very close to the molten glass supply from which it has been formed. Thus, the surface being marked is one which is at elevated temperatures, for example about 1800° F. and which is thus quite fragile and subject to damage should excessive thermal variation be encountered with the marking procedure. Because of the rigorous heated environment within which the apparatus 10 is positioned, it is desirable that the volatile inks or marking fluids employed for the marking procedure not be directed through a conventional conduiting or the like to the apparatus 10 but somehow be retained in a protected reservoir therewithin. Further, the marking procedure must be unconventional so as to accommodate the fragile surfaces being marked and the device must be of such rugged design as to be capable of performing reliably over many cycles and in response to available control signals employed in the industrial production process. By positioning the apparatus 10 or a grouping thereof for matrix based character formation at an appropriate location within the rigorous environment at hand, an identification mark or marks may be placed on the product at a certain matrix location such that, at industrial production downstream locations, information becomes available as to which machine generated the product. Apparatus 10 is seen to be formed having a small, compact metal housing 12 which, as represented generally in phantom is configured having a rectangular shaped side surface 14 and, outwardly disposed therefrom, the housing assumes an L-shaped configuration which includes a forwardly depending region 16. Rearwardly disposed of forward extending portion 16 is an upwardly-depending reservoir region 18 which will be seen to retain a reservoir cavity for retaining marking fluid. Attached to the side surface 14 is a control module 20 which is configured having an internally formed cavity within which a control circuit may be retained in a suitably protected fashion, for example by potting procedures or the like.

Forward depending region 16 is seen to extend to a nebulizing nozzle 22 which is positionable in spaced adjacency with respect to the surface being marked. Nozzle 22 is demountable for cleaning purposes and the like is seen in the figures to include a nozzle body 24 over which is threadably positioned a cap 26 having a knurled portion 28 facilitating manual removal of the cap 26. Actuation of the nozzle 22 is provided by a solenoid drive represented generally at 30 shown having an energizing lead 32 extending toward the control module 20 retained circuitry. Electrical input to the device 10 is provided through an electrical connector 34 and this input generally will be a signal for the device 10 to carry out a marking procedure. For this purpose a conventional 24 v a.c. signal is utilized. Control module 20 is seen to be affixed to the surface 18 of housing 12 by four machines screws 51–53. Inasmuch as all of the control components for the device 10 are retained within the readily removably module 20, the arrangement provides a convenience both in terms of cost and maintenance. In the latter regard, modules as at 20 may simply be replaced in the event of malfunction.

Positioned above the reservoir region 18 is a threaded closure or cap 40 providing access to the marking fluid reservoir which, in turn, is pressurized from an external source of pressurized air which communicates with the reservoir via a hose connector 42. This same air or gas under pressure will be seen to be conveyed for control over the nozzle 22 to a three-way valve 44 mounted upon the upwardly-disposed surface 46 of forwardly depending region 16 provided, for example, as a Model 111B three-way valve marketed by Mac Valves, Inc. of Wixom, Michigan, valve 44 is solenoid-actuated to perform in a normally open manner, venting to the atmosphere. Selective actuation of the valve is provided by an energizing input asserted from the control module 20 via a lead as at 48 which extends through an opening 49 within side surface or flange portion 14 of housing 12.

Figure 3:
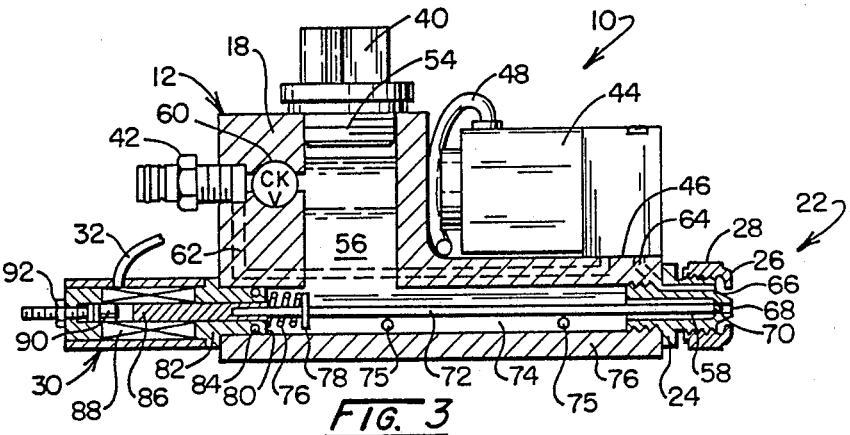
FIG. 3 is sectional view of the marker apparatus of FIG. 1 taken through the plane 3—3 shown in FIG. 2.

Looking to FIG. 3, the filler cap 40 is seen to be threadably engaged at 54 with reservoir region 14 of housing 12 and is positioned above the reservoir shown at 56 which extends in an L-shaped cross-section to the input channel 58 of nozzle 22. Reservoir 56 is operated under air pressure, i.e. about 20 psig by an unput from connector 42. A check valve represented schematically at 60 is positioned intermediate the reservoir 56 and connector 42 such that upon removal of an air supply hose from connector 42, the marking fluid within reservoir 56 will not be expelled. This same air supply asserted from connection 42 also is employed to provide a pressurized air input to valve 44. This input is developed through the housing 12 as represented by internally bored conduit 62 extending to the air input of valve 44. In turn, the actuating output from valve 44 is seen to be coupled through internally formed conduit 64 for assertion through an air outlet 66 circumferentially disposed about the fluid outlet 68 of nozzle 22. This outlet 68 is normally blocked by the tip 70 of an elongate needle which resides in submerged fashion within the elongate lower portion 74 of reservoir 56. Ball bearings 75 or the like are located within the reservoir to provide agitation or mixing of the marking ink or fluid within reservoir 56. The needle tip 70 provides a normal unenergized closure of fluid outlet 68 by virtue of a return spring 76 which is compressibly retained about needle 72 by abuttment against a flange 78 and the inwardly-depending surface 80 of a holder 82. Holder 82 forms a component of the solenoid drive 30 and is retained within the reservoir channel 74 inter alia by an O-ring seal 84. Needle 72 is seen coupled to an armature 86 which is, in turn, slideably drivably moveable by selected excitation of a solenoid coil 88. A plunger 90 is positioned within the channel within which armature 86 is slideably movable to adjust the travel thereof. The adjusting position of plunger 90 is provided by a threaded extension thereof and adjusting nut assemblage 92.

To achieve a non-destructive marking, the needle 72-plunger 30 arrangement is actuated in conjunction with the actuation of valve 44 such that a brief pulse of air is provided which has an interval bracketing the expression of a small amount of marking fluid or ink. The air envelope or interval generally will have a duration of less than about 50 milliseconds, the actuation of valve 44 being such as to achieve the noted bracketing. Looking to FIG. 4, a representation of the duration of the air pulse is represented by schematic curve 100 as it relates to the duration of expression of ink from opening 68 as represented by schematic curve 102. In effect, the activity occuring is one in which a "puff" of air brackets and nebulizes the expression of a droplet of marking fluid and the thus-nebulized minute particles of fluid then are directed into the high temperature atmosphere of the surface being marked. It is opined that the subminiature particles essentially are dry before contacting the surface. The result is that the surface so marked is not crazed or similarly thermally affected.

Figure 5:
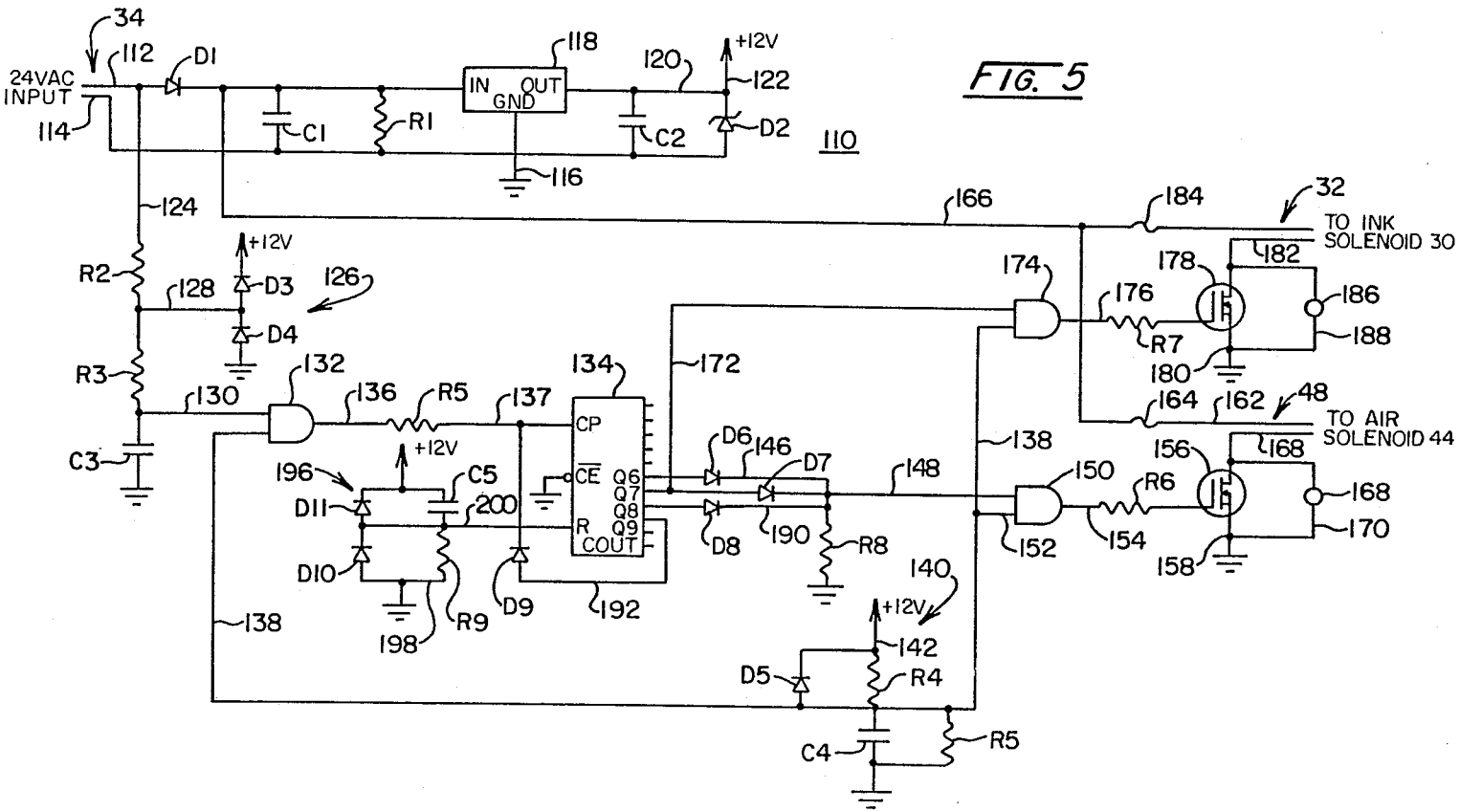
FIG. 5 is an electrical schematic diagram of a circuit employed with the apparatus of FIG. 1.

Looking to FIG. 5, the circuit which is encapsulated within the control module 20 (FIG. 2) is revealed schematically and in general at 110. Circuit 110 employs a conventional 24 volt a.c. industrial input signal to carry out one actuation of the device 10. Such inputs are generally available within an industrial environment and are shown being introduced to the circuit 110 at lines 112 and 114. At this 24 volt a.c. signal is applied, diode D1 within line 112 functions as a halfway rectifier charging an electrolytic capacitor C1 coupled between line 112 and 114. Capacitor C1 thus is charged up upon the application of the a.c. input. When the latter input is removed, a resistor R1 is provided to promote discharge of capacitor C1. Line 114 is seen to be connected to ground through line 116, and line 112 is seen to be directed to the input of a 12 volt, 1 amp d.c. regulator 118 which may be provided, for example, as a type LM7812. Regulator 118 develops a +12 volt signal at line 120 which is filtered by capacitor C2 and protected against possible solenoid induced inductive spikes by a 14 volt Zener diode D2. The resultant +12 v d.c. power supply is represented at arrow 122. This +12 v d.c. power supply functions to provide power to gate, counter, and other components of the control circuit 110 and enhances the stand alone nature of the design of device 10.

Returning to line 112, it may be observed that the +24 v a.c. signal is tapped at line 124 which is directed through limiting resistor R2 whereupon it is treated by a clipping network 126 coupled to line 124 via line 128 and incorporating diodes D3 and D4 connected, respectively, between ground and +12 v supply. A resultant 24 v a.c. signal then varies between approximately 0 and 12 volts. The clipped signal is filtered by the filter pair comprised of resistor R3 and capacitor C3 for treatment of any spikes or noise associated with the a.c. signal and the resultant a.c. signal, which typically will be at 60 Hz, is fed via line 130 to one input of an AND gate 132. Gate 132 functions to feed the input of a decade counter 134 via lines 136 and 137 upon being enabled from line 138. Line 138 functions to enable an output at line 136 of gate 132 upon the termination of a start-up delay. This delay is generated by a start-up delay network 140 comprised of resistor R4 and capacitor C4 coupled between +12 v supply and ground at line 142. Capacitor C4 is discharged in operation by large value resistor R5 and a diode D5 is provided within network 140 to effect the rapid discharge of capacitor C4 upon the removal of the 24v a.c. actuating input at line 112. The delay provided by network 140 permits time for the development of a stable +12 v power supply as at line 122 and the resultant powering up of gates and logic components for an initial few cycles of the a.c. input.

Following the start-up delay from network 140, AND gate 132 is enabled and the clipped, 12 to 0 volt 60 Hz signal at line 136 is directed through isolating resistor R5 to the CP (Clock Pulse) input of decade counter 134. Counter 134 may, for example, be provided as a type 4017 having a chip enable input coupled to ground and incorporating ten (decade) outputs, Q0–Q9. Of these terminals, terminal Q6 is seen to be tapped by line 146 which extends through diode D6 to line 148 and one input of AND gate 150. The opposite input to gate 150 derives from the enabling line 138 and line 152 to provide a corresponding gating signal at output line 154 extending through a gate resistor R6 to the gate of FET drive transistor 156. The gate-source terminals of transistor 156 are coupled via lines 158 and 160 between ground and one input to the solenoid winding of air valve 44, while the opposite powering input to the solenoid winding of that valve is derived from lines 162 extending through fuse 164 to line 166 which is seen to carry the half-wave rectified 24 v a.c. input from line 112. Transistor 156 is protected by a metal oxide varistor MOV 168 coupled within line 170 across the source and drain terminals thereof. With the arrangement shown, upon counter 134 reaching a condition wherein output terminal Q6 is activated, transistor 156 is turned on to commence the energization of the solenoid winding of air valve 44 and, thus, commence the direction of nebulizing air through channel 64 and the nozzle 22. Upon the next a.c. cycle increment of counter 134, terminal Q7 is activated to forward bias diode D7 within line 148 and maintain the above-described on condition at transistor 156 and consequent energization of air valve 44. However, line 148 additionally is seen to be tapped by line 172 leading, in turn, to one input of AND gate 174. The opposite input to gate 174 derives from enabling line 138 to provide a positive output at line 176 which is seen to extend through gate resistor R7 to the gate of FET transistor 178. The drain and source terminals of transistor 178 are coupled between ground and one input to the winding 88 of marking fluid actuating solenoid 30 by respective lines 180 and 182. An opposite drive input to these windings is provided from earlier-described line 166 and fuse 184. As before, transistor 178 is protected by an (MOV) varistor as at 186 coupled across the drain and source terminals thereof by line 188.

As terminal Q8 of counter 134 is activated, the signal from terminal Q7 is removed to, in turn, remove the energization from winding 88 of solenoid 30. However, energizing activation of the solenoid winding of air valve 44 continues by the activation of counter terminal Q8. Terminal Q8 is coupled to line 190 functioning to forward bias diode D8 and, in turn, maintain a positive signal at line 148 to retain the on condition at drive transistor 156. A protective resistor R8 is seen coupled between line 190 and ground.

Figure 4:
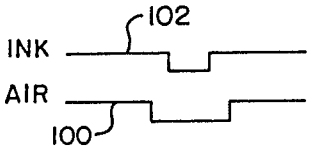
FIG. 4 is timing diagram showing the intervals of actuation applied for expressing marking fluid and air in conjunction with the nozzle of the apparatus of FIG. 10.

As counter 134 transitions from the activation of terminal Q8 to the activation of terminal Q9, the bracketing output result represented by the combination of curves 100 and 102 in FIG. 4 is defined. As terminal Q9 is activated, line 192 coupled thereto functions to forward bias diode D9 and assert a signal to line 137 which is isolated by resistor R5 to, in effect, disable or "lock-up" counter 134. This condition remains until the signal at lines 112 and 114 is removed and capacitor C4 of start-up delay network 140 is discharged.

Counter 134 is "locked-up" by the reset network at 196 on power up until such a time that a capacitor C5 becomes charged. Network 196 is seen to be comprised of timing capacitors and resistors shown, respectively, at C5 and R9 within line 198 coupled between +12 v and ground. The common connection of these timing components is coupled by line 200 to the reset terminal, R, of counter 134 as well as intermediate level controlling diodes D10 and D11 restricting the voltage level at the reset terminal of counter 134 to values between 12 v and 0 v.

Since certain changes may be made in the above apparatus and method without departing from the scope of the invention herein involved, it is intended that all matter contained in the above description or shown in the accompanying drawings shall be interpreted as illustrative and not in a limiting sense.

What is claimed is:

1. Apparatus for marking fragile surfaces at elevated temperatures with an identification mark employing marking fluid nebulized from a source of air under pressure comprising:

a housing mountable in the vicinity of said surface;

supply means for supplying said marking fluid;

nozzle means mounted on said housing, having a fluid outlet communicating with said supply means and actuable for releasing a quantity of said fluid sufficient only to form said identification mark while avoiding damage to said surface induced by localized cooling effects, having an air inlet and an air outlet which is adjacent and in substantially surrounding relationship with said fluid outlet for receiving air under pressure at said inlet and effecting a nebulization of said released fluid;

air valve means connectable with said source of air under pressure and with said nozzle means air inlet and actuable to supply air under pressure to said nozzle means air inlet;

control means for selectively actuating said nozzle means and said air valve means in pulsed fashion wherein said air valve means effects commencement of entraining air flow from said nozzle means air outlet to said surface subsequent to which said nozzle means expresses a said quantity of marking fluid within a first predetermined interval sufficient only to effect creation of a said identification mark, and said air valve means effecting termination of said air flow subsequent to said first predetermined interval to define a second predetermined interval of said air flow having a minimal duration selected to effect nebulization of said expressed quantity of marking fluid and avoid damage to said fragile surface due to thermal effects.

2. The apparatus of claim 1 in which said supply means comprises a reservoir for retaining said marking fluid, formed within said housing and in fluid communication with said nozzle means.

3. The apparatus of claim 2 including coupling means connectable with said source of air for pressurizing said fluid within said reservoir.

4. The apparatus of claim 3 including check valve means positioned intermediate said reservoir and said source of air for preventing expulsion of said fluid upon removal of said source of air.

5. The apparatus of claim 1 in which said control means includes pulse defining network means for actuating said air valve to effect derivation of said predetermined interval of less than about 5.0 milliseconds.

6. Apparatus for marking fragile surfaces at elevated temperature to form a discrete identification mark with marking fluid in conjunction with a source of gas under pressure in response to an a.c. input signal, comprising:

a housing mountable in the vicinity of said surface;

supply means for supplying a quantity of marking fluid;

nozzle means mounted on said housing having a fluid outlet communicating with said supply means and an electromagnetic fluid actuator energizable for releasing said fluid for expression through said fluid outlet and having a gas outlet adjacent said fluid outlet communicating with a gas inlet for effecting a transport of said expressed fluid toward said surface;

air valve means connectable with said source of gas and with said nozzle means gas inlet and actuable to effect release of said gas under pressure through said gas outlet in response to energization of an electromagnetic valve actuator; and control means including first drive means responsive to a first on signal for energizing said electromagnetic valve actuator, second drive means responsive to a second on signal for energizing said electromagnetic fluid actuator, counter means responsive to said a.c. input to sequentially activate a sequence of output terminals, first connection means for coupling a predetermined sequence of at least three of said terminals from first to last with said first drive means to apply said first on signal thereto to effect said actuation of said air valve means for a first interval having a minimal duration selected to effect said transport and nebulization of said fluid while avoiding damage to said surface due to localized cooling, and second connector means for coupling at least one said terminals intermediate said first to last terminals with said second drive means to apply said second on signal thereto for a second interval occuring intermediate said first interval and selected of duration to express a quantity of said fluid sufficiently to effect creation of a said identification mark while avoiding damage to said surface induced by localized cooling effects.

7. The apparatus of claim 6 in which said control means is retained within a protective control module affixed to said housing.

8. The apparatus of claim 7 in which said control means includes power supply means responsive to said a.c. input signal for deriving a d.c. power supply of predetermined voltage level for energizing said counter means.

9. The apparatus of claim 8 in which said control means includes:

start-up delay network means having an enabling output in the presence of power supply means predetermined voltage level; and gate means responsive to said enabling output for enabling said counter means.

10. The apparatus of claim 6 in which said supply means comprises a reservoir for retaining said marking fluid, formed within said housing and in fluid communication with said nozzle means.

11. The apparatus of claim 10 including coupling means connectable with said source of under pressure for pressurizing said fluid gas within said reservoir.

12. The apparatus of claim 6 in which said control means includes pulse defining network means for actuating said air valve to effect derivation of said first interval of about 50 milliseconds.

* * * * *